US006752456B1

(12) United States Patent
Latham

(10) Patent No.: US 6,752,456 B1
(45) Date of Patent: Jun. 22, 2004

(54) STOOL APPARATUS

(76) Inventor: Darrell Latham, 122 W. Main St. Box 26, Eitzen, MN (US) 55931

( * ) Notice: Subject to any disclaimer, the term of this patent is extended or adjusted under 35 U.S.C. 154(b) by 0 days.

(21) Appl. No.: 10/358,718

(22) Filed: Feb. 5, 2003

(51) Int. Cl.[7] ..... A47C 9/00
(52) U.S. Cl. ..... 297/217.7; 297/298
(58) Field of Search ..... 297/4, 310, 217.1, 297/217.7, 298, 334

(56) References Cited

U.S. PATENT DOCUMENTS

| | | | | | |
|---|---|---|---|---|---|
| 1,271,170 | A | * | 7/1918 | Jellinek et al. | 248/240.2 |
| 1,448,253 | A | * | 3/1923 | Bodker | 312/202 |
| 1,642,633 | A | * | 9/1927 | Vittengl et al. | 312/298 |
| 1,688,415 | A | * | 10/1928 | Fox | 248/126 |
| 2,306,812 | A | * | 12/1942 | Ketive | 297/142 |
| D159,534 | S | * | 8/1950 | Raichert | D6/338 |
| 2,824,598 | A | * | 2/1958 | Ertl | 297/143 |
| 2,963,332 | A | * | 12/1960 | Breuning | 312/231 |
| 3,073,648 | A | * | 1/1963 | Johnson | 297/142 |
| 3,330,609 | A | * | 7/1967 | Tippett | 312/235.3 |
| 3,481,429 | A | * | 12/1969 | Gaede | 182/88 |
| 4,070,715 | A | * | 1/1978 | Reppas | 5/2.1 |
| 4,135,604 | A | * | 1/1979 | Ryan | 182/91 |
| 4,240,662 | A | | 12/1980 | Anderson | |
| 4,406,495 | A | * | 9/1983 | Turner | 297/135 |
| 4,736,998 | A | * | 4/1988 | Wilson et al. | 312/235.3 |
| 4,841,584 | A | | 6/1989 | Overcash et al. | |
| 5,085,290 | A | | 2/1992 | Guirlinger | |
| 5,358,067 | A | * | 10/1994 | Ford et al. | 182/91 |
| 5,755,498 | A | * | 5/1998 | Cutler | 312/235.1 |
| 6,234,553 | B1 | * | 5/2001 | Eschelbach et al. | 296/65.14 |

* cited by examiner

*Primary Examiner*—Peter M. Cuomo
*Assistant Examiner*—Joseph Edell

(57) ABSTRACT

A stool apparatus for permitting a user to sit while using a sink. The stool apparatus includes a frame assembly being designed for being pivotally coupled to a cabinet positioned below the sink. The frame assembly is pivotal between a stored position and a deployed position. The stored position is defined by the frame assembly being positioned in the cabinet. The deployed position is defined by the frame assembly extending from the cabinet. A seat member is coupled to the frame assembly. The seat member is designed for being positioned a distance from the sink when the frame assembly is in the deployed position. The seat member is designed for supporting the user in a seated position when the user is using the sink.

8 Claims, 4 Drawing Sheets

STOOL APPARATUS

BACKGROUND OF THE INVENTION

1. Field of the Invention

The present invention relates to folding chairs and more particularly pertains to a new stool apparatus for permitting a user to sit while using a sink.

2. Description of the Prior Art

The use of folding chairs is known in the prior art. U.S. Pat. No. 4,240,662 describes a device for supporting a user while the head of the user is positioned over a sink. Another type of folding chair is U.S. Pat. No. 4,841,584 having lounge chair that is coupled to a cabinet and positions the head of the user over a sink to have the hair of the user washed. U.S. Pat. No. 5,085,290 has a step device that is coupled to a cabinet door and folds down from the cabinet door to allow user to step on the step device to reach a high area.

SUMMARY OF THE INVENTION

An object of the present invention is to provide a new stool apparatus that is extendable from a cabinet below a sink to support a user who is using the sink.

Even still another object of the present invention is to provide a new stool apparatus that is adjustable to allow a desired positioning of the seat member for the most comfort of the user.

To this end, the present invention generally comprises a frame assembly being designed for being pivotally coupled to a cabinet positioned below the sink. The frame assembly is pivotal between a stored position and a deployed position. The stored position is defined by the frame assembly being positioned in the cabinet. The deployed position is defined by the frame assembly extending from the cabinet. A seat member is coupled to the frame assembly. The seat member is designed for being positioned a distance from the sink when the frame assembly is in the deployed position. The seat member is designed for supporting the user in a seated position when the user is using the sink.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
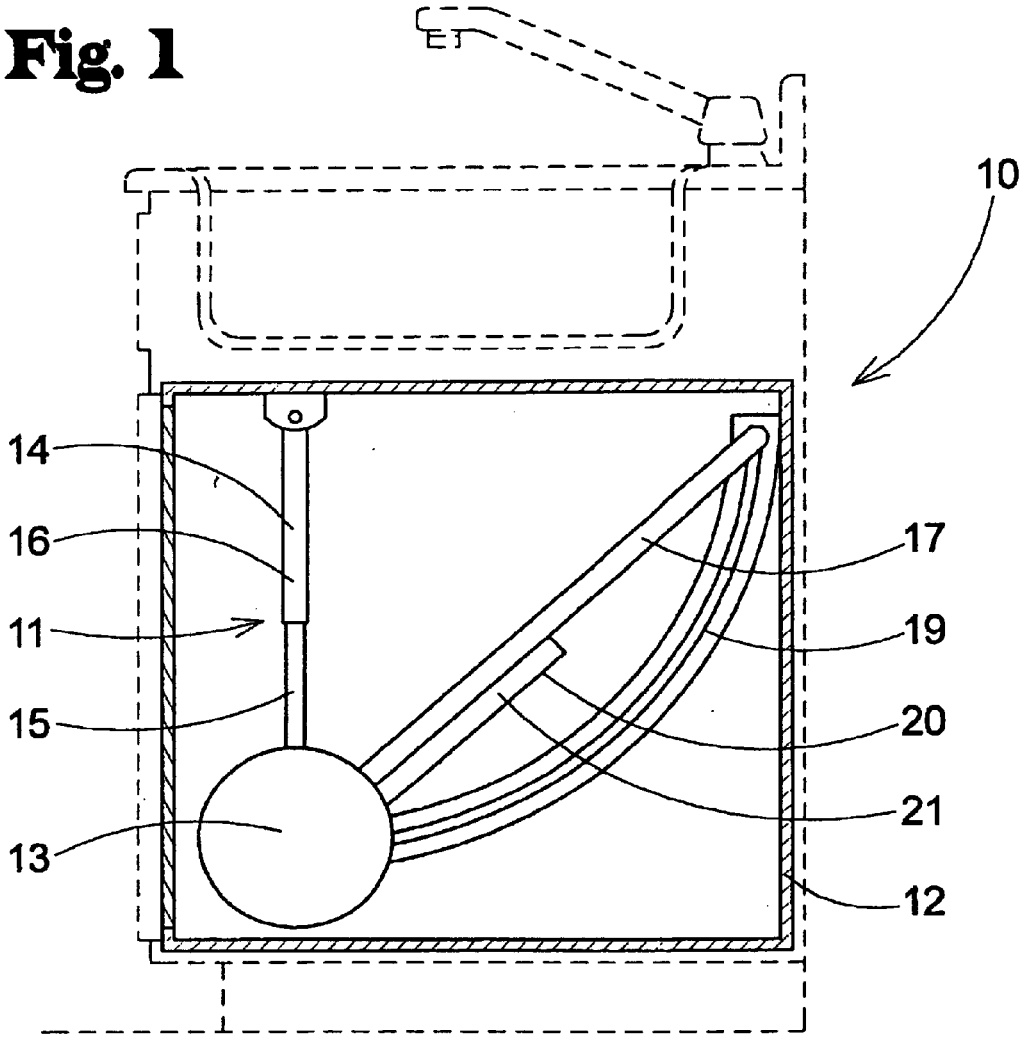
FIG. 1 is a side view of a new stool apparatus according to the present invention in the stored position.
Figure 2:
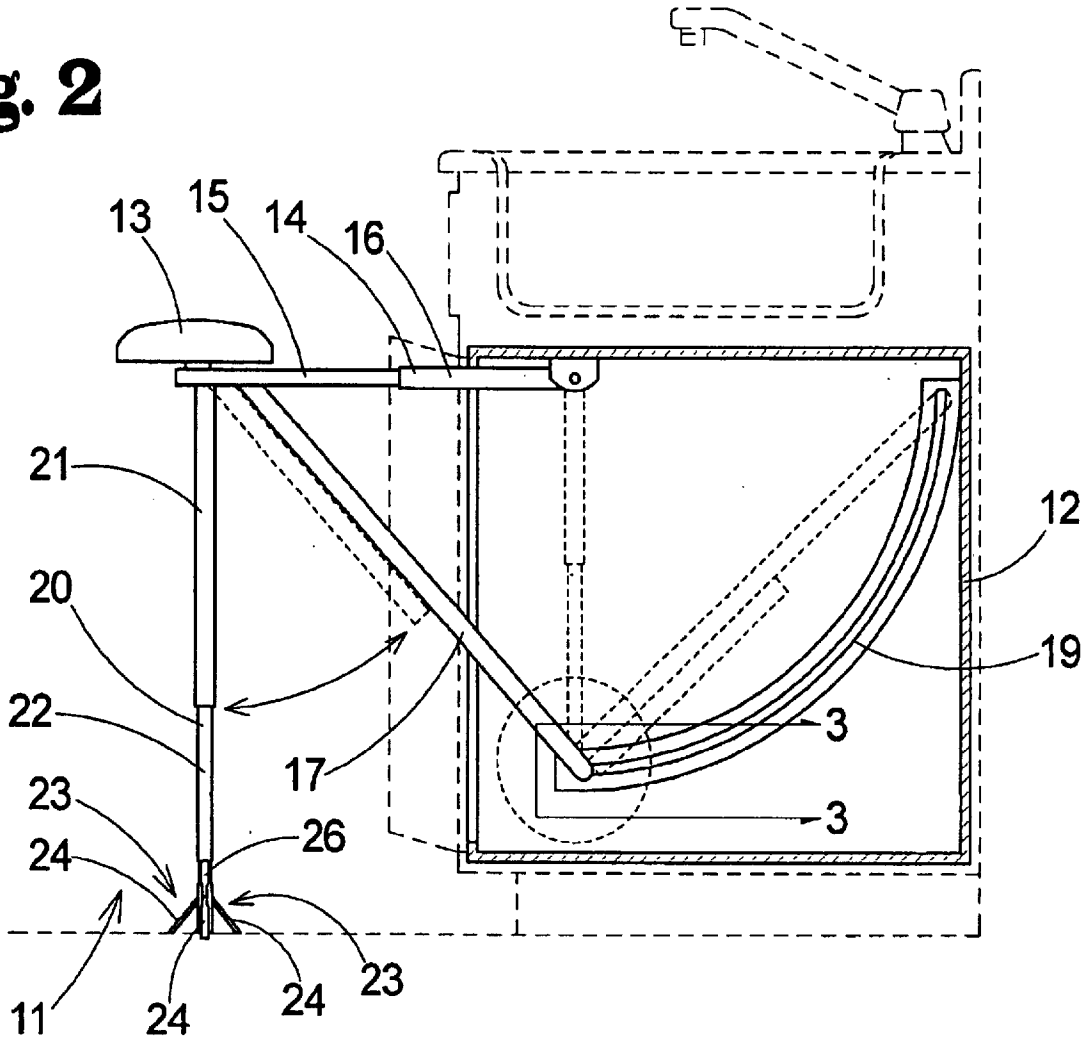
FIG. 2 is a side view of the present invention shown in the deployed position.
Figure 3:
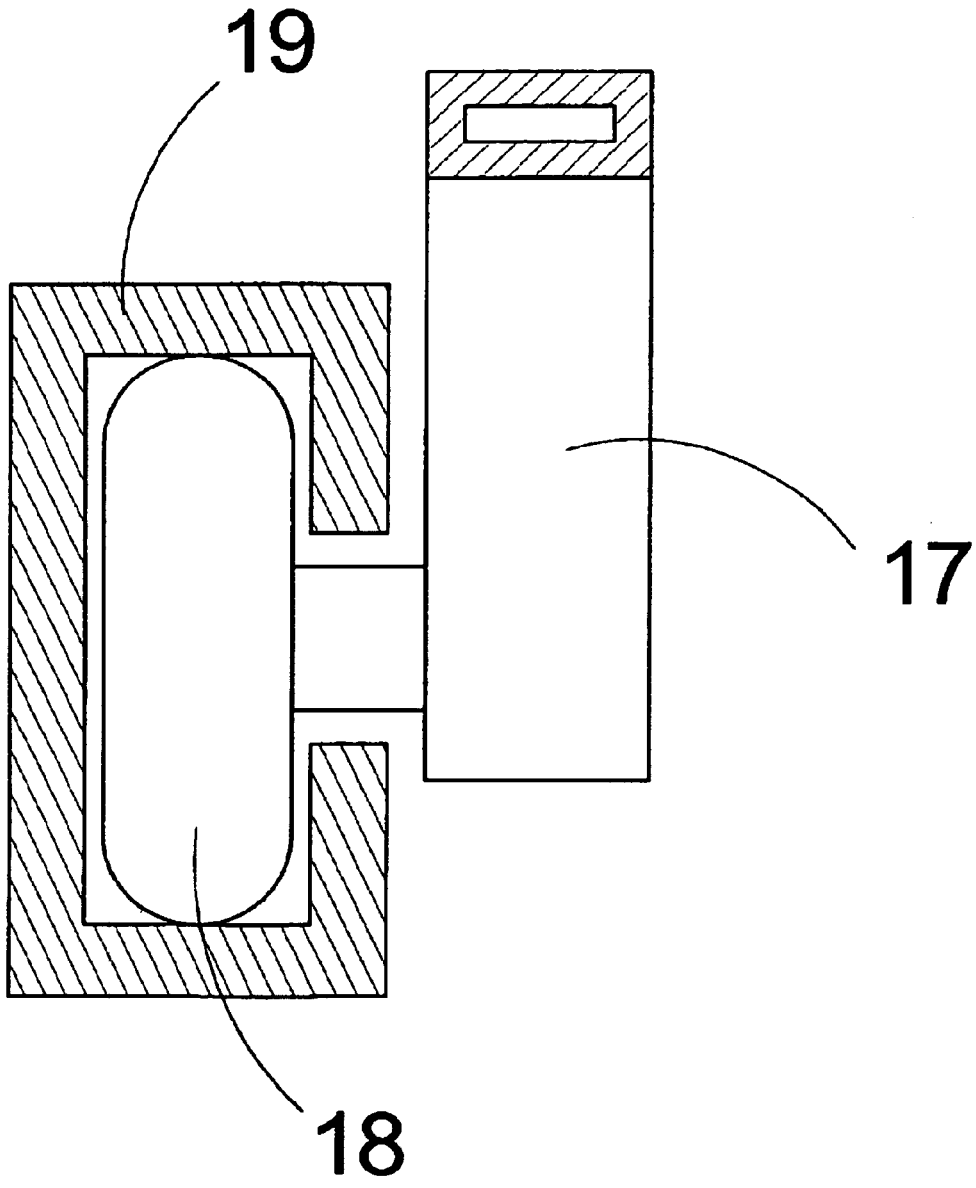
FIG. 3 is a cross-sectional view of the present invention taken along line 3—3 of FIG. 2.
Figure 4:
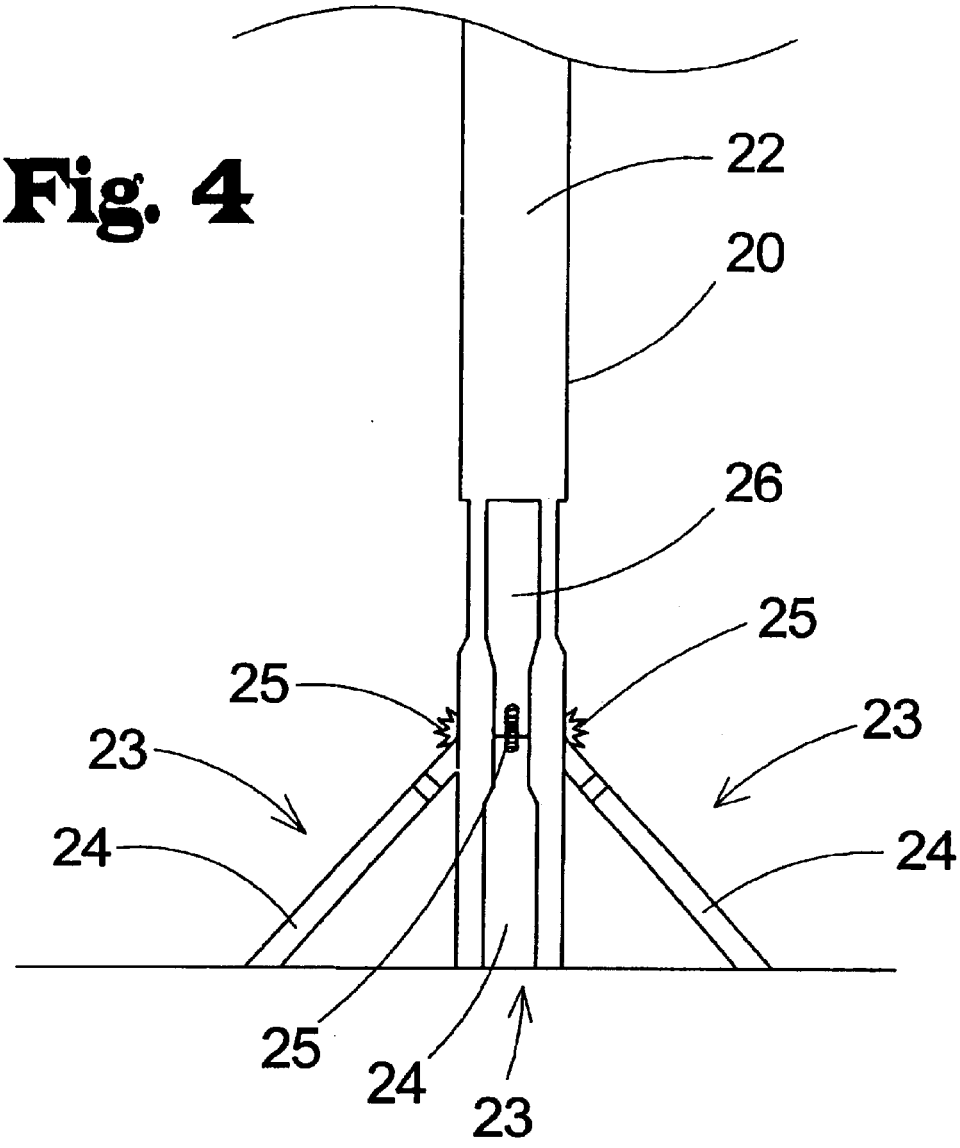
FIG. 4 is a enlarged view of the foot assemblies of the present invention.

With reference now to the drawings, and in particular to FIGS. 1 through 4 thereof, a new stool apparatus embodying the principles and concepts of the present invention and generally designated by the reference numeral 10 will be described.

As best illustrated in FIGS. 1 through 4, the stool apparatus 10 generally comprises a frame assembly 11 being designed for being pivotally coupled to a cabinet 12 positioned below the sink. The cabinet 12 may be a self contained unit and selectively positioned below the sink and accessible when the cabinet door is opened. The frame assembly 11 is pivotal between a stored position and a deployed position. The stored position is defined by the frame assembly 11 being positioned in the cabinet 12. The deployed position is defined by the frame assembly 11 extending from the cabinet 12.

A seat member 13 is coupled to the frame assembly 11. The seat member 13 is designed for being positioned a distance from the sink when the frame assembly 11 is in the deployed position. The seat member 13 is designed for supporting the user in a seated position when the user is using the sink.

The frame assembly 11 comprises a main member 14. The main member 14 is designed for being pivotally coupled to the cabinet 12. The seat member 13 is coupled to the main member 14 whereby the seat member 13 is designed for being positioned opposite the cabinet 12. The main member 14 is designed for supporting the user seated on the seat member 13 when the frame assembly 11 is in the deployed position.

The main member 14 comprises a sleeve portion 15 and an extension portion 16. The sleeve portion 15 slidably receives the extension portion 16 whereby a length of the main member 14 is adjustable. The sleeve portion 15 is slid with respect to the extension portion 16 for adjusting a distance the seat member 13 is positioned from the sink. The extension portion 16 is designed for being hingably coupled to the cabinet 12. The sleeve portion 15 is coupled to the seat member 13.

The seat member 13 is hingably coupled to the main member 14 whereby the seat member 13 is pivotal between a receiving position and a storage position. The receiving position is defined by the seat member 13 being positioned above the main member 14 whereby the seat member 13 is designed for supporting the user when the frame assembly 11 is in the deployed position. The storage position is defined by the seat member 13 being positioned along a side of the main member 14 whereby the storage position of the seat member 13 is for conserving space when the frame assembly 11 is in the stored position.

The frame assembly 11 comprises a bracing member 17. The bracing member 17 is coupled to the main member 14. The bracing member 17 is designed for being slidably coupled to the cabinet 12 whereby the bracing member 17 extends between the main member 14 and the cabinet 12. The bracing member 17 is for providing additional support for the main member 14 when the seat member 13 is supporting the user.

The frame assembly 11 comprises a guide wheel 18 and a track member 19. The guide wheel 18 is rotatably coupled to the bracing member 17 whereby the guide wheel 18 is positioned opposite the main member 14. The track member 19 is designed for being coupled to the cabinet 12. The track member 19 receiving the guide wheel 18 whereby the guide wheel 18 rolls alone a length of the track member 19. The guide wheel 18 is for facilitating a smooth transition of the frame assembly 11 between the stored position and the deployed position when the guide wheel 18 rolls along the track member 19.

The frame assembly 11 comprises a support member 20. The support member 20 is coupled to the main member 14. The support member 20 extends downwardly from the main member 14 whereby the support member 20 is designed for extending between the main member 14 and a support surface when the frame assembly 11 is in the deployed position. The support member 20 is designed for supporting the weight of the user when the seat member 13 is supporting the user and the support member 20 engages the support surface.

The support member 20 is hingably coupled to the main member 14. The support member 20 is pivotal between a parallel position and a support position. The parallel position is defined by the support member 20 being positioned substantially parallel to the bracing member 17 when the frame assembly 11 is in the stored position. The support position is defined by the support member 20 being pivoted away from the bracing member 17 whereby the support member 20 is designed for extending between the main member 14 and the support surface when the frame assembly 11 is positioned in the deployed position.

The support member 20 comprises a receiving portion 21 and a support portion 22. The receiving portion 21 slidably receives the support portion 22 whereby a length of the support member 20 is selectively adjustable. The receiving portion 21 is coupled to the main member 14. The support member 20 is designed for engaging the support surface when the support portion 22 is extended from the receiving portion 21. The support portion 22 is slid into the receiving portion 21 when the support member 20 is being pivoted into the parallel position.

The support member 20 comprises a plurality of foot assemblies 23. Each of the foot assemblies 23 is coupled to the support portion 22 opposite the receiving member. Each of the foot assemblies 23 selectively extends from the support member 20 whereby each of the foot assemblies 23 is designed for engaging the support surface when the support member 20 is in the support position. The foot assemblies 23 are designed for engaging the support surface and preventing tipping of the support member 20 when the user is seated on the seat member 13.

Each of the foot assemblies 23 comprises a foot member 24 and a biasing member 25. The foot member 24 is pivotaly coupled to the support portion 22 of the support member 20 whereby the foot member 24 of each of the foot assemblies 23 is positioned in one of a plurality of slots 26 in the support portion 22 of the support member 20. The biasing member 25 is coupled between the support portion 22 and the foot member 24 of the associated one of the foot assemblies 23 whereby the biasing member 25 angles the foot member 24 out from the associated one of the slots 26 in the support portion 22 to engage the support surface when the support portion 22 engages the support surface. The foot member 24 of each of the foot assemblies 23 is selectively positionable in the associated one of the slots 26 to allow the support portion 22 to be slid into the receiving portion 21 of the support member 20 when the support member 20 is being pivoted to the parallel position.

In use, the user open the door to the cabinet 12 and pulls the frame assembly 11 out of the stored position and into the deployed position. The user then extends the support portion 22 from the receiving portion 21 to engage the support surface with the foot member 24 of each of the foot assemblies 23 and the support portion 22 of the support member 20. The user then pivots the seat member 13 from the storage position to the receiving position and sits on the seat member 13 while doing the dishes. The user reverses the order return the frame assembly 11 to cabinet 12 when not being used.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stool apparatus for being stored and deployed from under a sink to allow a user to sit while using the sink, the stool apparatus comprising:

a frame assembly being adapted for being pivotally coupled to a cabinet positioned below the sink, said frame assembly being pivotal between a stored position and a deployed position, said stored position being defined by said frame assembly being positioned in the cabinet, said deployed position being defined by said frame assembly extending from the cabinet;

a seat member being coupled to said frame assembly, said seat member being adapted for being positioned a distance from the sink when said frame assembly is in said deployed position, said seat member being adapted for supporting the user in a seated position when the user is using the sink;

said frame assembly comprising a main member, said main member being adapted for being pivotally coupled to the cabinet, said seat member being coupled to said main member such that said seat member is adapted for being positioned opposite the cabinet, said main member being adapted for supporting the user seated on said seat member when said frame assembly is in said deployed position;

said frame assembly comprising a support member, said support member being coupled to said main member, said support member extending downwardly from said main member such that said support member is adapted for extending between said main member and a support surface when said frame assembly is in said deployed position, said support member being adapted for supporting the weight of the user when said seat member is supporting the user and said support member engages the support surface;

said support member comprising a receiving portion and a support portion, said receiving portion slidably receiving said support portion such that a length of said support member is selectively adjustable, said receiving portion being coupled to said main member, said support member being adapted for engaging the support surface when said support portion is extended from said receiving portion, said support portion being slid into said receiving portion when said support member is being pivoted into said parallel position;

said support member comprising a plurality of foot assemblies, each of said foot assemblies being coupled to said support portion opposite said receiving portion, each of said foot assemblies selectively extending from said support member such that each of said foot assemblies is adapted for engaging the support surface when said support member is in said support position, said foot assemblies being adapted for enzaging the support surface and preventing tipping of said support member when the user is seated on said seat member; and each of said foot assemblies comprising a foot member and a biasing member, said foot member being pivotaly coupled to said support portion of said support member such that said foot member of each of said foot assemblies is positioned in one of a plurality of slots in said support portion of said support member, said biasing member being coupled between said support portion and said foot member of the associated one of said foot assemblies such that said biasing member angles said foot member out from the associated one of said slots in said support portion to engage the support surface when said support portion engages the support surface, said foot member of each of said foot assemblies being selectively positionable in the associated one of said slots to allow said support portion to be slid into said receiving portion of said support member when said support member is being pivoted to said parallel position.

2. The stool apparatus as set forth in claim 1, further comprising:

said main member comprising a sleeve portion and an extension portion, said sleeve portion slidably receiving said extension portion such that a length of said main member is adjustable, said sleeve portion being slid with respect to said extension portion for adjusting a distance said seat member is positioned from the sink, said extension portion being adapted for being hingably coupled to the cabinet, said sleeve portion being coupled to said seat member.

3. The stool apparatus as set forth in claim 1, further comprising:

said seat member being hingably coupled to said main member such that said seat member is pivotal between a receiving position and a storage position, said receiving position being defined by said seat member being positioned above said main member such that said seat member is adapted for supporting the user when said frame assembly is in said deployed position, said storage position being defined by said seat member being positioned along a side of said main member such that said storage position of said seat member is for conserving space when said frame assembly is in said stored position.

4. The stool apparatus as set forth in claim 1, further comprising:

said frame assembly comprising a bracing member, said bracing member being coupled to said main member, said bracing member being adapted for being slidably coupled to the cabinet such that said bracing member extends between said main member and the cabinet, said bracing member being for providing additional support for said main member when said seat member is supporting the user.

5. The stool apparatus as set forth in claim 4, further comprising:

said frame assembly comprising a guide wheel and a track member, said guide wheel being rotatably coupled to said bracing member such that said guide wheel is positioned opposite said main member, said track member being adapted for being coupled to the cabinet, said track member receiving said guide wheel such that said guide wheel rolls along a length of said track member, said guide wheel being for facilitating a smooth transition of said frame assembly between said stored position and said deployed position when said guide wheel rolls along said track member.

6. The stool apparatus as set forth in claim 4, further comprising:

said support member being hingably coupled to said main member, said support member being pivotal between a parallel position and a support position, said parallel position being defined by said support member being positioned substantially parallel to said bracing member when said frame assembly is in said stored position, said support position being defined by said support member being pivoted away from said bracing member such that said support member is adapted for extending between said main member and the support surface when said frame assembly is positioned in said deployed position.

7. The stool apparatus as set forth in claim 1, further comprising:

said support member being hingably coupled to said main member, said support member being pivotal between a parallel position and a support position, said parallel position being defined by said support member being pivoted towards said main member when said frame assembly is being pivoted into said stored position, said support position being defined by said support member being pivoted away from said main member such that said support member is adapted for extending between said main member and the support surface when said frame assembly is positioned in said deployed position.

8. A stool apparatus for being stored and deployed from under a sink to allow a user to sit while using the sink, the stool apparatus comprising:

a frame assembly being adapted for being pivotally coupled to a cabinet positioned below the sink, said frame assembly being pivotal between a stored position and a deployed position, said stored position being defined by said frame assembly being positioned in the cabinet, said deployed position being defined by said frame assembly extending from the cabinet;

a seat member being coupled to said frame assembly, said seat member being adapted for being positioned a distance from the sink when said frame assembly is in said deployed position, said seat member being adapted for supporting the user in a seated position when the user is using the sink;

said frame assembly comprising a main member, said main member being adapted for being pivotally coupled to the cabinet, said seat member being coupled to said main member such that said seat member is adapted for being positioned opposite the cabinet, said main member being adapted for supporting the user seated on said seat member when said frame assembly is in said deployed position;

said main member comprising a sleeve portion and an extension portion, said sleeve portion slidably receiving said extension portion such that a length of said main member is adjustable, said sleeve portion being slid with respect to said extension portion for adjusting a distance said seat member is positioned from the sink, said extension portion being adapted for being hingably coupled to the cabinet, said sleeve portion being coupled to said seat member;

said seat member being hingably coupled to said main member such that said seat member is pivotal between a receiving position and a storage position, said receiving position being defined by said seat member being positioned above said main member such that said seat member is adapted for supporting the user when said frame assembly is in said deployed position, said storage position being defined by said seat member being positioned along a side of said main member such that said storage position of said seat member is for conserving space when said frame assembly is in said stored position;

said frame assembly comprising a bracing member, said bracing member being coupled to said main member, said bracing member being adapted for being slidably coupled to the cabinet such that said bracing member extends between said main member and the cabinet, said bracing member being for providing additional support for said main member when said seat member is supporting the user;

said frame assembly comprising a guide wheel and a track member, said guide wheel being rotatably coupled to said bracing member such that said guide wheel is positioned opposite said main member, said track member being adapted for being coupled to the cabinet, said track member receiving said guide wheel such that said guide wheel rolls along a length of said track member, said guide wheel being for facilitating a smooth transition of said frame assembly between said stored position and said deployed position when said guide wheel rolls along said track member;

said frame assembly comprising a support member, said support member being coupled to said main member, said support member extending downwardly from said main member such that said support member is adapted for extending between said main member and a support surface when said frame assembly is in said deployed position, said support member being adapted for supporting the weight of the user when said seat member is supporting the user and said support member engages the support surface;

said support member being hingably coupled to said main member, said support member being pivotal between a parallel position and a support position, said parallel position being defined by said support member being positioned substantially parallel to said bracing member when said frame assembly is in said stored position, said support position being defined by said support member being pivoted away from said bracing member such that said support member is adapted for extending between said main member and the support surface when said frame assembly is positioned in said deployed position;

said support member comprising a receiving portion and a support portion, said receiving portion slidably receiving said support portion such that a length of said support member is selectively adjustable, said receiving portion being coupled to said main member, said support member being adapted for engaging the support surface when said support portion is extended from said receiving portion, said support portion being slid into said receiving portion when said support member is being pivoted into said parallel position;

said support member comprising a plurality of foot assemblies, each of said foot assemblies being coupled to said support portion opposite said receiving portion, each of said foot assemblies selectively extending from said support member such that each of said foot assemblies is adapted for engaging the support surface when said support member is in said support position, said foot assemblies being adapted for engaging the support surface and preventing tipping of said support member when the user is seated on said seat member; and each of said foot assemblies comprising a foot member and a biasing member, said foot member being pivotaly coupled to said support portion of said support member such that said foot member of each of said foot assemblies is positioned in one of a plurality of slots in said support portion of said support member, said biasing member being coupled between said support portion and said foot member of the associated one of said foot assemblies such that said biasing member angles said foot member out from the associated one of said slots in said support portion to engage the support surface when said support portion engages the support surface, said foot member of each of said foot assemblies being selectively positionable in the associated one of said slots to allow said support portion to be slid into said receiving portion of said support member when said support member is being pivoted to said parallel position.

* * * * *